US005996325A

United States Patent [19]

Gauder et al.

[11] Patent Number: 5,996,325

[45] Date of Patent: Dec. 7, 1999

[54] MACHINE FOR TWISTING CONDUCTOR CABLES TOGETHER

[75] Inventors: Edgar Gauder, Embourg, Belgium; Philippe Bayard, Veauche, France; Serge Perrier, Mozac, France; Michel Guret, Mably, France

[73] Assignee: Societe Nouvelle Setic SA, Roanne, France

[21] Appl. No.: 09/015,401

[22] Filed: Jan. 29, 1998

[30] Foreign Application Priority Data

Jan. 30, 1997 [FR] France ..... 97 01241

[51] Int. Cl.[6] ..... D01H 1/10; D01H 7/86

[52] U.S. Cl. ..... 57/58.52; 57/58.54; 57/58.7; 57/58.72

[58] Field of Search ..... 57/58.49, 58.52, 57/58.54, 58.55, 58.7, 58.72

[56] References Cited

U.S. PATENT DOCUMENTS

| | | | |
|---|---|---|---|
| 3,791,131 | 2/1974 | Scott et al. | 57/58.54 |
| 3,867,809 | 2/1975 | Holbrook | 57/58.52 |
| 5,564,268 | 10/1996 | Thompson | 57/58.55 |
| 5,622,039 | 4/1997 | Thompson | 57/58.52 |

FOREIGN PATENT DOCUMENTS

| | | | |
|---|---|---|---|
| 20 52 705 | 5/1971 | Germany . | |
| 450 232 | 4/1968 | Switzerland . | |
| 608254 | 12/1978 | Switzerland | 57/58.54 |

*Primary Examiner*—William Stryjewski
*Attorney, Agent, or Firm*—Oliff & Berridge, PLC

[57] ABSTRACT

This machine comprises a number of elements mounted fitted one inside the other, and in succession, from the outside inward, a large lyre (10) which is rotated, a large cradle (12) which is stationary, two small lyres (15) which are coaxial and rotated in opposite directions, two small cradles (22) which are stationary and placed in the volume of the two lyres (15) and two reels (24) of wire each rotated inside a small cradle. The wires are twisted for a first time on the small lyres (15), then twisted together in the opposite direction on the large lyre (10).

6 Claims, 3 Drawing Sheets

MACHINE FOR TWISTING CONDUCTOR CABLES TOGETHER

The subject of the present invention is a machine for twisting conductor cables together, these cables being intended in particular for transmitting data and producing telephone connections.

Buildings are often wired for the transmission of data within them, this wiring being achieved using cables comprising four pairs of wires twisted together, each pair of wires itself already having been twisted together. A wire consists of a central conductor made of copper, surrounded by a sheath of insulation. The twist exerted on the wire presents the risk of damaging the quality, altering the geometry and physical properties thereof by causing the copper element and the insulation surrounding it to become detached from one another. Now, for high bit rates which may be as high as 600 MHz, it is essential that the cable should not exhibit any electrical defect.

A first solution for producing a conventional cable consists in forming a pair from two wires paid out from two reels, the two wires passing over a lyre which twists the two wires together. The pair thus obtained is wound onto a reel. Four reels of pairs of wires are paid out simultaneously so that the four pairs of wires can be twisted together using a lyre.

It is also possible to produce a cable that has four pairs twisted together in a single step, by employing a device known as a twinner set which has four units, each unit comprising a lyre mounted on a bed which twists together two wires which are paid out from two reels housed in the volume of revolution of the lyre. The twisted pairs leaving the twinner set are twisted together using a single- or double-twist machine. Bearing in mind the drawbacks inherent in successively twisting a wire in the same direction, it is desirable that, for each wire, the first twist should be in the opposite direction to the pairing and twisting-together twist so that the finished wire should have experienced the least possible strain and so that the resulting twist on the wire should be smaller.

The use of a solution of this kind requires a process in a number of successive stages.

The object of the invention is to provide a machine for twisting together conductor cables intended for the transmission of data which in particular allows the cables to be produced in a single step in which each wire is reverse-twisted to start with.

For this purpose, the machine to which it relates comprises:

- a bed on which there are mounted, so that they can pivot in bearings, two coaxial hollow shafts which are rotated and connected by at least one bent element forming a large lyre, equipped with means for longitudinally guiding wires,
- a large cradle which, placed inside the volume defined by the large lyre, is mounted on the hollow shafts, with the insertion of bearings, so that the large cradle remains stationary when the shafts rotate, the large cradle having at least one central cross member perpendicular to the axis of the hollow shafts and delimiting two compartments,
- two profiled elements forming two small lyres which, aligned axially and each equipped with wireguiding means, are placed inside the two compartments of the large cradle and are mounted so that they can pivot with respect thereto by means of bearings, about an axis that corresponds to that of the hollow shafts, the two small lyres being rotated in opposite directions,

- two small cradles, each one placed in the volume defined by one small lyre and mounted in the corresponding small lyre by means of bearings so that they do not rotate when the small lyre is rotated,
- two reels carrying the wires to be twisted together, these reels each being rotated inside a small cradle about an axis parallel to that of the small lyre, and
- wire-guiding means comprising, in particular, in each compartment and starting from a reel: a wire-guiding roller, guide pulleys leading the wire axially and inward onto a small lyre which guides it as far as a point at which it leaves the lyre axially and inward, having undergone a first twist, the wires from the two reels then being guided parallel to one another by pulleys mounted on the large cradle until they leave the large cradle axially at one end of the large lyre, which guides the wires and twists them together, twisting in the opposite direction to the previous twisting operations, the wires thus twisted together emerging axially from the other end of the lyre.

This machine has the overall geometry of a so-called twinner set machine, with the additional possibility that, for each wire, it can carry out two twists in opposite directions to one another, one twist in a first direction then a pairing twist in a second direction so as to obtain a twisted pair in which the wires have the least possible amount of residual strain.

It is possible to have one wire on each reel, so as to obtain a twisted pair leaving the machine. Four machines of this type may be combined so that four pairs of wires can be twisted together at the same time and in parallel.

According to another possibility, it is possible to have two wires in parallel wound on each reel. The first twist carried out using a small lyre allows the two wires paid out from one and the same reel to be twisted together. The large lyre allows four wires already twisted together in pairs to be twisted together.

According to another possibility, it is possible to reverse the direction of the machine. The wires coming from the outside undergo a double twist in the large lyre then another double twist in one of the small lyres and are wound onto the reel carried by the cradle. This device allows quadruple-twist combining.

In any case, the invention will be clearly understood from the description which follows with reference to the appended diagrammatic drawing which, by way of non-limiting example, depicts one embodiment of this machine intended to form a pair of wires.

Figure 1:
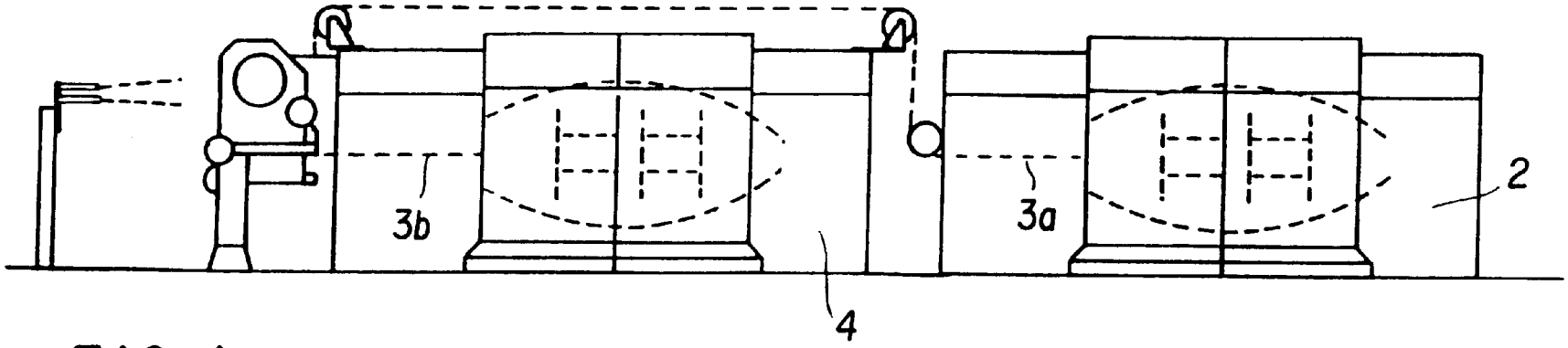
FIG. 1 is a side view of an installation comprising four machines according to the invention and making it possible to obtain a cable that consists of four pairs of wires.
Figure 2:
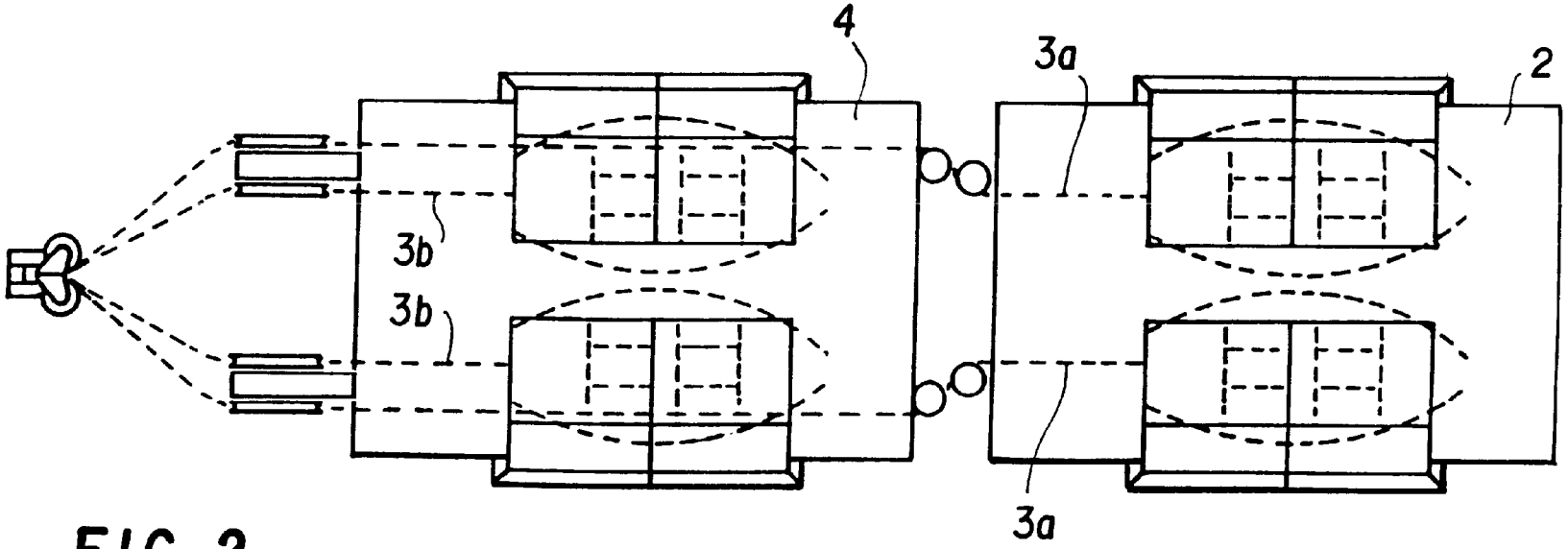
FIG. 2 is a view of this machine from above.
Figure 3:
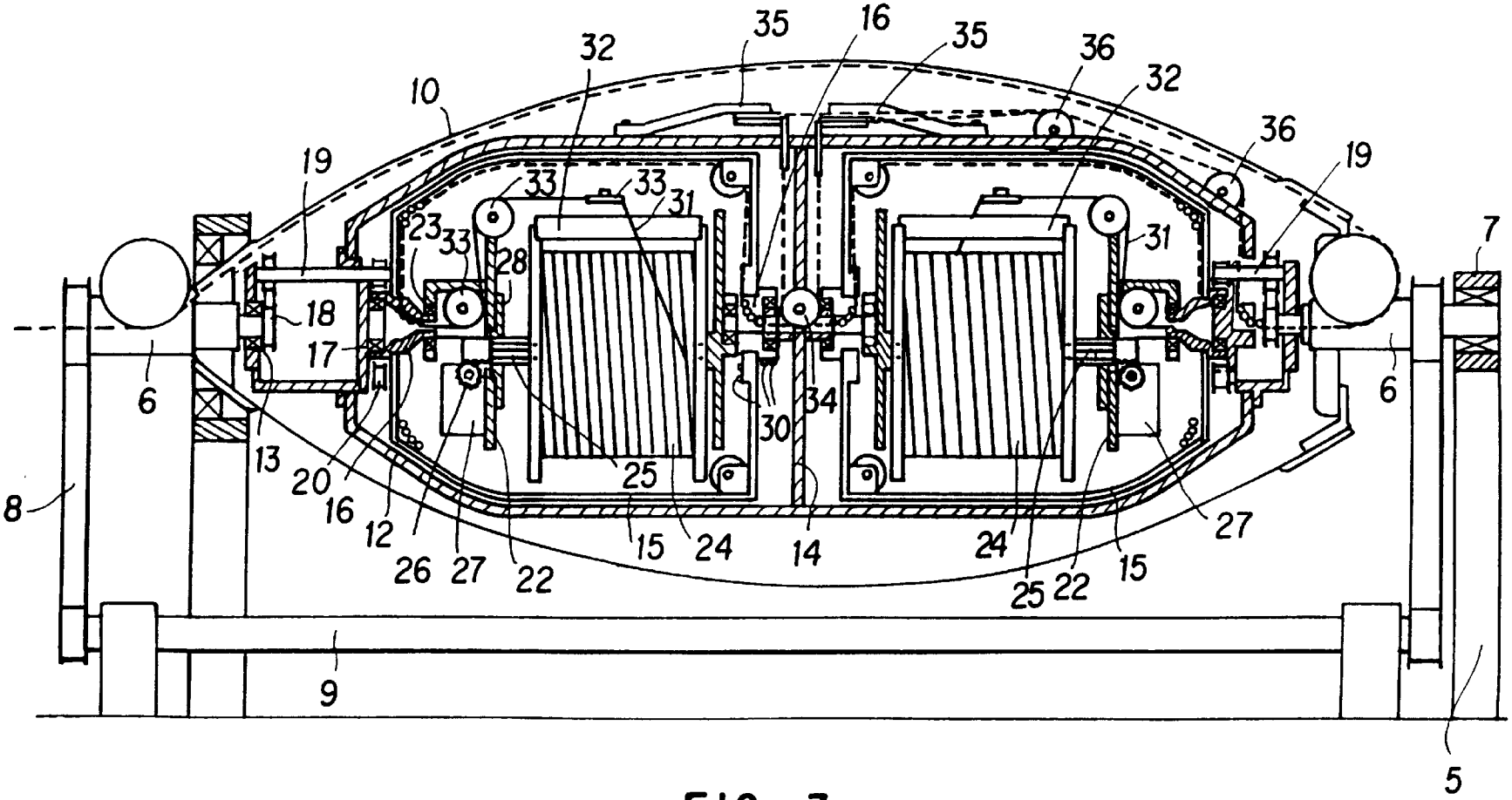
FIG. 3 is a view from above and in part section of the machine according to the invention.
Figure 4:
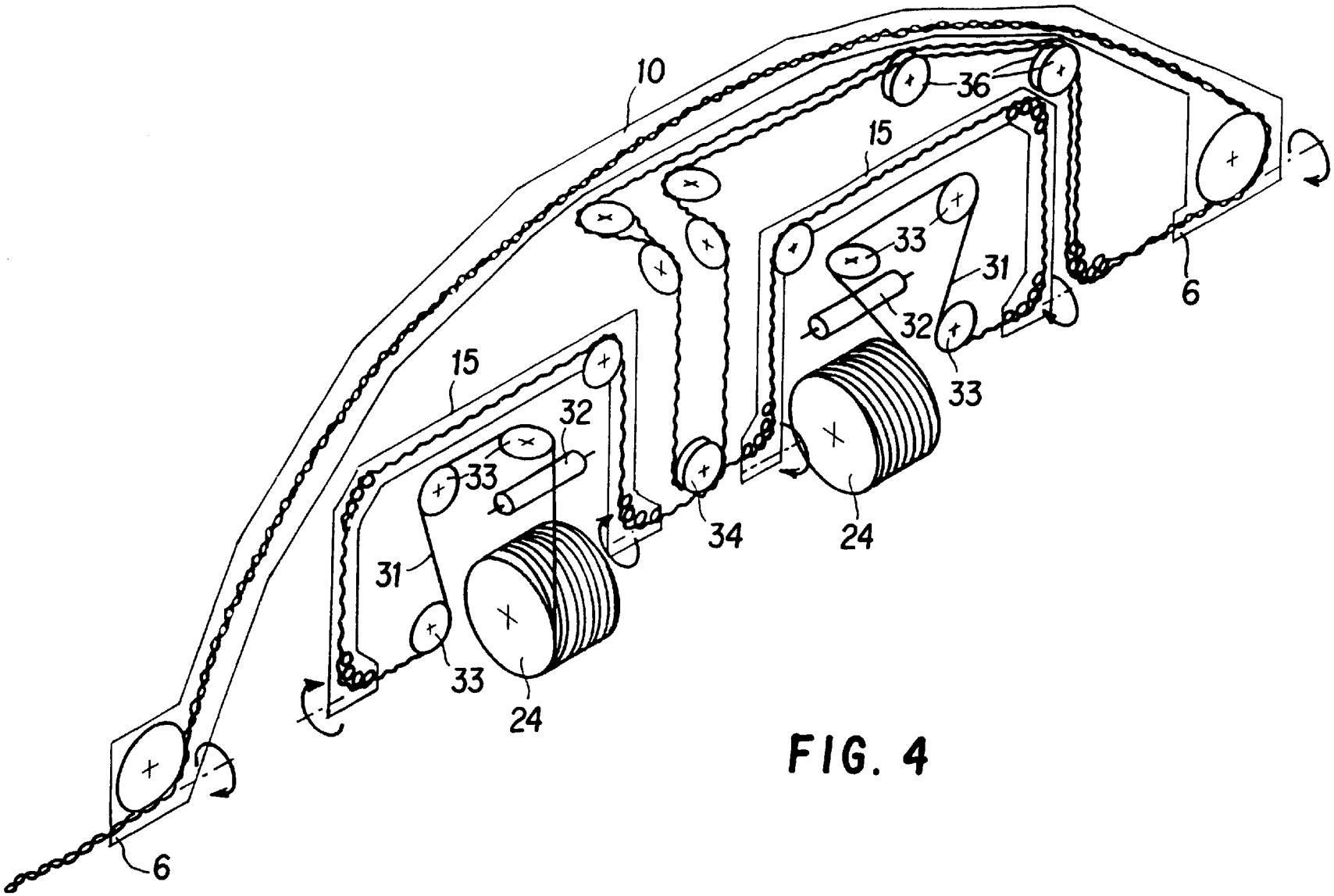
FIG. 4 is a view in perspective diagrammatically illustrating the path taken by the wires inside the machine.

FIG. 1 depicts an installation comprising four machines grouped in pairs. The two groups of machines are aligned axially with respect to each other. Each machine 2 of a first group makes it possible to obtain a pair of wires 3*a* twisted together. These wires 3*a* pass over the group comprising the two machines 4. The two machines 4 supply two pairs of wires 3*b* which are guided parallel to the wires 3*a* to be twisted together with these wires at a station which has not been depicted in the drawings.

Each machine comprises a bed 5 on which there are mounted so that they can pivot, by means of bearings 7, two coaxial hollow shafts. The hollow shafts are rotated by belts 8 off a drive shaft 9. The two hollow shafts 6 are connected by a bent piece 10 forming a lyre, equipped with means for guiding wires and twisting them together. Mounted on the hollow shafts 6 with the insertion of bearings 13 is a large cradle 12 placed inside the volume defined by the large lyre 10 as it rotates. Thus, as the large lyre 10 rotates, the large cradle 12 does not rotate about its axis. This large cradle 12 has at least one. central cross member 14 perpendicular to the axis of the hollow shafts 6 and delimiting two compartments. Placed inside each compartment of the large cradle is a profiled piece equipped with wire-guiding means, forming a small lyre 15. Each small lyre is mounted via two coaxial supports 16 on the large cradle 12 and on the cross member 14 thereof respectively, with the insertion of rolling bearings 17. Each small lyre 15 is rotated off a hollow shaft 6 using a first belt 18 passing around the hollow shaft and driving a secondary shaft 19 which itself drives a belt 20 fixed to a support 16 of the small lyre. Placed inside each small lyre 15 is a small cradle 22. Each small cradle is mounted on the supports 16 of the corresponding small lyre 15 with the insertion of rolling bearings 23. Each small cradle 22 is used to mount a reel 24. The small cradle has a stationary spike on one side, over which the reel is engaged, and on the other side has a spike 25 which can be shifted axially by means of a pinion 26 meshing with a rack in order either to cause the reel to be clamped by the spike 25 or, on the other hand, to retract this same spike.

Mounted on the small cradle 22 is an electric motor 27, fixed to the output shaft of which there is a pinion which meshes with pinion 28 fixed on the spike 25.

To stabilize the reel and prevent any risk of the support of the latter and of the large cradle being rotated inside the large lyre, the axis of each reel 24 is offset with respect to the axis common to the hollow shafts, the large cradle, the small lyres and the small cradles. Power is supplied to each electric motor 27, and the movement of each reel is controlled, by means of commutators 30 mounted on the rotating parts and rubbing on brushes secured to the stationary parts opposite them.

The path taken by each wire starting from a reel 24 is as follows: the wire 31 passes over a wire-guiding roller 32 then over pulleys 33 which lead the wire axially and outward over a small lyre 15. The wire follows this small lyre and is twisted, bearing in mind the rotation of this small lyre, in such a way that it leaves axially inward. The two wires paid out from the two reels pass over parallel pulleys 34, then over jumping-jack mechanisms 35 that regulate the tension of the wire, and are guided in parallel over pulleys 36 secured to the large cradle. The two parallel wires emerge axially from the large cradle 12 and are then taken up by the large lyre 10 which they follow along its entire length, before re-emerging axially at the other end of the machine. The movement of the two wires as they travel along, combined with the rotational movement of the large lyre causes these two wires to be twisted together. It should be noted that the small lyre 15 lying in the compartment on the right-hand side of the drawing rotates in the opposite direction to the large lyre, while the small lyre 15 lying in the compartment on the left-hand side rotates in the same direction as the large lyre. What happens is that the machine depicted in the drawing is intended first of all to twist each of the wires from the two reels in a first direction, then to twist them together in the other direction so that once the pair has been formed, the wire has the least possible amount of internal strain.

In an alternative embodiment, it would be possible to place two wires in parallel on each reel 24, the rotation of a small lyre twisting together the two wires corresponding to this reel, then the large lyre twisting together the two pairs thus formed.

As is clear from the foregoing, the invention provides a great improvement to the existing state of the art by providing a machine which allows twisted-together wires to be obtained in a single operation, with it being possible for the torsion of these wires to be removed before they are twisted together.

As goes without saying, the invention is not limited merely to the embodiment of this machine which has been described hereinabove by way of example; on the contrary, it encompasses all alternative forms thereof. Thus in particular, the shape of the lyres, the layout of the reels could be different, or alternatively, the means of driving the small lyres could be different, without this in any way departing from the scope of the invention.

We claim:

1. Machine for twisting conductor wires together, characterized in that it comprises:

a bed (5) on which there are mounted, so that they can pivot in bearings (7), two coaxial hollow shafts (6) which are rotated and connected by at least one bent element forming a large lyre (10), equipped with means for longitudinally guiding wires, a large cradle (12) which, placed inside the volume defined by the large lyre (10), is mounted on the hollow shafts (6), with the insertion of bearings (13), so that the large cradle (12) remains stationary when the shafts rotate, the large cradle having at least one central cross member (14) perpendicular to the axis of the hollow shafts and delimiting two compartments, two profiled elements (15) forming two small lyres which, aligned axially and each equipped with wire-guiding means, are placed inside the two compartments of the large cradle (12) and are mounted so that they can pivot with respect thereto by means of bearings (16), about an axis that corresponds to that of the hollow shafts, the two small lyres (15) being rotated in opposite directions, two small cradles (22), each one placed in the volume defined by one small lyre (15) and mounted in the corresponding small lyre by means of bearings (23) so that they do not rotate when the small lyre (15) is rotated, two reels (24) carrying the wires to be twisted together, these reels each being rotated inside a small cradle (22) about an axis parallel to that of the small lyre, and wire-guiding means comprising, in particular, in each compartment and starting from a reel: a wire-guiding roller (32) for guide pulleys (35) leading the wire (31) axially and inward onto a small lyre (15) which guides it as far as a point at which it leaves the lyre axially and inward, having undergone a first twist, the wires (31) from the two reels (24) then being guided parallel to one another by pulleys (36) mounted on the large cradle (12) until they leave the large cradle (12) axially at one end of the large lyre (10), which guides the wires and twists them together, twisting in the opposite direction to the previous twisting operation, the wires thus twisted together emerging axially from the other end of the lyre.

2. Machine according to claim 1, characterized in that the hollow shafts (6) carrying the large lyre (10) are rotated using belts (8) off a drive shaft (9).

3. Machine according to claim 1, characterized in that the means of driving each small lyre (15) consist of a belt (18)

which, driven by a hollow shaft (6), itself drives a secondary shaft (19) parallel to the axis of this hollow shaft and mounted so that it can pivot on the large cradle (12), the secondary shaft (19) driving, by means of a belt (20), the shaft (16) on which a small lyre is fitted.

4. Machine according to claim 1, characterized in that the axis of the reels (24) is offset with respect to the common axis of the hollow shafts (6), the large cradle (12), the small lyres (15) and the small cradles (22).

5. Machine according to claim 1, characterized in that each small cradle (22) carries an electric motor (27), fixed to the output shaft of which there is a pinion which meshes with another pinion (28) fixed on a spike (25) on which a reel (24) is fixed.

6. Machine according to claim 1, characterized in that power is supplied to each electric motor (27), and the movement of each reel (24) is controlled, by means of commutators (3) mounted on the rotating parts and rubbing on brushes secured to the stationary parts opposite them.

* * * * *